US005915555A

United States Patent [19]

Ball

[11] Patent Number: 5,915,555

[45] **Date of Patent: *Jun. 29, 1999**

[54] PACKAGING MATERIAL, APPARATUS AND METHOD

[75] Inventor: Joseph F. Ball, Monroe Falls, Ohio

[73] Assignee: Automated Packaging Systems, Inc., Streetsboro, Ohio

[ * ] Notice: This patent is subject to a terminal disclaimer.

[21] Appl. No.: 08/155,730

[22] Filed: Nov. 22, 1993

Related U.S. Application Data

[63] Continuation of application No. 07/847,662, Mar. 5, 1992, Pat. No. 5,310,056, which is a continuation of application No. 07/809,048, Dec. 16, 1991, Pat. No. 5,174,449, which is a continuation-in-part of application No. 07/593,335, Oct. 1, 1990, abandoned, which is a continuation of application No. 06/864,026, May 16, 1986, abandoned.

[51] Int. Cl.[6] ..... B65D 85/67

[52] U.S. Cl. ..... 206/390; 206/409

[58] Field of Search ..... 206/389, 390, 206/554, 820, 409; 383/37; 242/71, 71.2, 71.6, 71.8

[56] References Cited

U.S. PATENT DOCUMENTS

| | | | |
|---|---|---|---|
| 3,254,828 | 6/1966 | Lerner | 383/37 |
| 3,993,260 | 11/1976 | Bauer, Sr. | 242/55.18 |
| 4,597,494 | 7/1986 | Benoit | 206/390 |
| 5,174,449 | 12/1992 | Ball | 206/390 |

*Primary Examiner*—David T. Fidei

*Attorney, Agent, or Firm*—Watts, Hoffmann, Fisher & Heinke Co., L.P.A.

[57] ABSTRACT

A coil of an interconnected chain of open bags is provided in which the coil has a center opening having a diameter at least as great as the transverse dimension of the bags. A dispenser is provided on which a coil of bags is mounted. An end of the chain is pulled from the center opening and fed around a tapered mandrel and thence over a feed control mandrel oriented in angular relationship with the tapered mandrel. The web is then fed to a bagging machine for dispensing, loading and closing of the bags. The table on which the coil is mounted is rotatable so that the orientation of a span of bags running from the coil to the tapered mandrel remains substantially constant as the web is fed.

8 Claims, 3 Drawing Sheets

PACKAGING MATERIAL, APPARATUS AND METHOD

This application is a Continuation of Ser. No. 07/847,662, filed Mar. 5, 1992, now U.S. Pat. No. 5,310,056, issued May 10, 1994 which, in turn was a Continuation of Ser. No. 07/809,048 filed Dec. 16, 1991, now U.S. Pat. No. 5,174,449, issued Dec. 29, 1992 which, in turn, was a Continuation-in-Part of application Ser. No. 07/593,335 filed Oct. 1, 1990, now abandoned which, in turn, was a File Wrapper Continuation of Ser. No. 06/864,026 filed May 16, 1986, now abandoned. The now issued patents being entitled CENTER FEED ROLL while the great-grandparent and originally filed application having been entitled PACKAGING MATERIAL APPARATUS AND METHOD.

REFERENCE TO RELEVANT PATENTS

1. U.S. Pat. Nos. 3,254,468, "Method of Packaging Articles," 3,298,580, "Container Delivery Apparatus," and 3,455,088, "Container Delivery Apparatus," all issued to Herhsey Lerner, here the Autobag Patents.
2. U.S. Pat. Nos. 3,815,318, 3,882,656, 3,956,866 and 4,014,154, each entitled "Packaging Method and Apparatus". U.S. Pat. Nos. 3,948,015 entitled "Packaging System" and 3,965,653 entitled "Packaging Apparatus", here the H-100 Patents.
3. U.S. Pat. No. 4,201,029 entitled "Method and Apparatus for Packaging", here the Wig Wag Patent.

TECHNICAL FIELD

This invention relates to methods of making and coiling a web of interconnected bags, coils of such bags and method and apparatus for dispensing such bags.

BACKGROUND ART

The Autobag Patents disclose a packaging technique in which a chain of interconnected open plastic bags are used. In the earliest commercial form a roll of these bags was mounted on a mandrel and the mandrel was positioned in a box. A blower was connected to the box. Bags were dispensed by feeding them closed end first, out of a slot in the box. Air from the blower exiting through the same slot would inflate each bag as it came out of the box. A product was manually inserted into the inflated bag and the bag was separated from the chain. The loaded and separated bag was then usually closed and heat sealed.

The boxes used in the described earliest commercial form were disposable shipping containers that also served as dispensing containers, As a next step in the evolution of equipment for effecting packaging with a chain of open bags on a roll, manually controlled dispensing machines were developed. Each machine was adapted to receive a coil of interconnected open bags. The bags were fed through a dispensing opening in the machine and then vertically downwardly along a path of travel. In a typical operation, after a bag had been blown open an operator would manually insert a product. The operator would then manually separate the loaded bag from the chain of bags and insert its open end into a heat sealer. Concurrently with the separation of the loaded bag the operator would feed the chain of bags to bring the next succeeding bag into the loading station.

More sophisticated automatic equipment has been developed for loading and sealing chains of open bags on a roll. An example of such equipment is that disclosed and claimed in the H-100 Patents. With that equipment, bags are automatically fed to a loading station. In addition, they are automatically sealed and separated from the chain after products have been loaded. The H-100 machines, like earlier machines until the invention of the Wig Wag Patent was made, used bags on a roll.

Manufacture of rolls of open bags has presented a problem. When the bags are used it is necessary to feed the bags closed end first. This has meant that as the bags have been wound into a coil they have been fed onto the coil being formed open end first. The bags must be fed quite slowly during a winding operation to avoid blowing the bags open excessively and tearing the web.

In order to achieve reasonable and efficient production speeds, bags have been fed closed end first during anufacture and coiled. Thereafter a "rewind" operation is performed at slow speeds to provide a finished coil from which bags are fed closed end first.

The Wig Wag Patent discloses a system by which bags were fed closed end first into a dispensing box and then dispensed on a first in—first out basis. To accomplish this, bags were arranged in a plicated array of horizontal layers. While this system has enjoyed some success, especially with relatively large bags, rewinding has continued to be used for most applications of Autobag products. While rewinding is expensive, in terms of overall efficiency it has prooved to be more efficient than the approach of the "Wig Wag." Patent for many applications because forming a plicated array in accordance with the teaching of that patent—slows the overall bag formation operation.

DISCLOSURE OF THE INVENTION

Practice of the present invention overcomes the drawbacks of the prior art by forming a coil of interconnected open bags in a novel and improved manner which permits bags to be fed from the center of a coil. The bags of the coil of this invention are preferably those that have been sold commercially under the trademark AUTOBAG and described in the Autobag patents. Since the bags are fed. from the center of the coil they are fed on a first wound, first unwound basis. This permits the bags to be wound closed end first and unwound closed end first without the expense of the time consuming prior rewind practice.

Dispensing bags by pulling them from the center or hole in an annular coil of bags presents a problem. With prior coils it could not effectively and reliably be done even if it has occurred to someone to try to, because with such coils bags tend to "bunch up" and resist coming from the center to the point where the bags tend to separate from the web along the preformed lines of weakness.

The solution to the "bunching" problem lies in the discovery that if the diameter of the central aperture or hole in the coil is at least as great as the width of a web in the form of a chain of flattened interconnected bags, the bags may be fed easily and directly from the center hole. Accordingly, webs of open but interconnected and flattened bags are formed by known processes and then fed closed end first and wound into coils of bags each having a central opening of a diameter at least as great as the width of the web.

To accomplish the feed from the center hole and control the feed of a web from a dispensing location to a product loading station, a novel web feed dispenser has been devised. This mechanism includes a bag supporting rotatable table mounted on a base. The table includes a coil supporting surface which is horizontal when in use. A tapered mandrel is connected to and projects upwardly from the table. A shaft for the tapered mandrel and table projects upwardly from a base and the table and tapered mandrel are journaled on this shaft.

The dispensing mechanism also includes a feed control mandrel. The feed control mandrel is preferably pivotally and removably mounted above the tapered mandrel. The feed control mandrel includes a rotatable cylindrical roll which is rotatable about the axis of the feed control mandrel.

In the preferred embodiment a support bracket is mounted on the tapered mandrel shaft. The support bracket has an upwardly directed open ended slot. A hanging bracket carries the feed control mandrel. The hanging bracket includes a pin which is removably received in the slot to provide a pivotal support for the feed control mandrel. The feed control mandrel includes a drive section which engages a driven section on the tapered mandrel. An adjustment mechanism is interposed between the brackets to adjust the angular relationship between the mandrels and the engagement of the drive and driven sections.

In dispensing, a coil of bags is mounted on the support surface and around the tapered mandrel. The feed control mandrel is then pivotally connected to the tapered mandrel. Bags are fed closed end first from the center of the coil along a path. The path angles upwardly from the center of the coil, reeves over a portion of the tapered mandrel, thence continuing upwardly over a portion of the feed control mandrel.

The web path includes a span from the feed control mandrel to a horizontally journaled idler roll. In this span the web under goes a slight twisting action to bring its major dimension horizontal. After passing over this horizontal idler roll, the web path continues to a loading station where bags are sequentially inflated and loaded. Once loaded, they are typically heat sealed and separated from the web in the manner disclosed in the H-100 Patents.

Another of the advantages of the present invention is that a series of coils of bags may be spliced together and stacked to provide trouble-free automatic dispensing over a long time frame without operator intervention. To accomplish this, the inner end of the bottom coil of a stack is connected to the outer end of the next to bottom coil and so on so that as the upper most coil is paid out it is spliced to the inner end of the next coil and the stack will automatically commence bag feeding from the next coil.

Accordingly, an object of the invention is to provide a novel and improved system for dispensing bags in the form of a web of interconnected open bags, a novel and improved coil of bags and a novel and improved dispensing mechanism.

Other objects and a fuller understanding of the invention may be had by referring to the following description and claims taken in conjunction with the accompanying drawings in which:

BEST MODE FOR CARRYING OUT THE INVENTION

The Web

Figure 1:
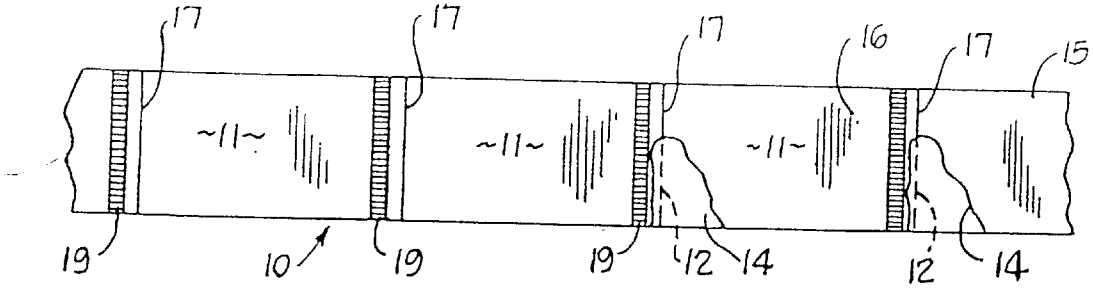
FIG. 1 is a plan view of a section of a web of bags of the type disclosed in the Autobag Patents.

Refering now to the drawings and FIG. 1 in particular, a web of bags of the type disclosed in the Autobag Patents is shown at 10. The web is in the form of a flattened plastic tube of bags 11 interconnected in end to end relationship. The bags are connected together and ends of contiguous bags are delineated by transverse lines of weakness preferably in the form of perforations 12. These perforations provide a parting line for facile separation of bags from the remainder of the web. As shown in FIG. 1, the perforations 12 are formed in a lower ply 14 visible in the two bags to the right were an upper ply 15 is broken away and removed to reveal the perforations. In the disclosed embodiment, the upper ply 15 of each bag 11 is open from one side edge to another at a location longitudinally coincident with the perforations 12 and indicated by the reference numeral 17.

Bag ply interconnections in the form of heat seals are provided at 19. The heat seals 19 both contribute to maintaining the web in a flattened condition with the plies in juxtaposed relationship and function to delineate the bottoms of fillable spaces for receiving products during a bagging operation.

Web Manufacture

Figure 2:
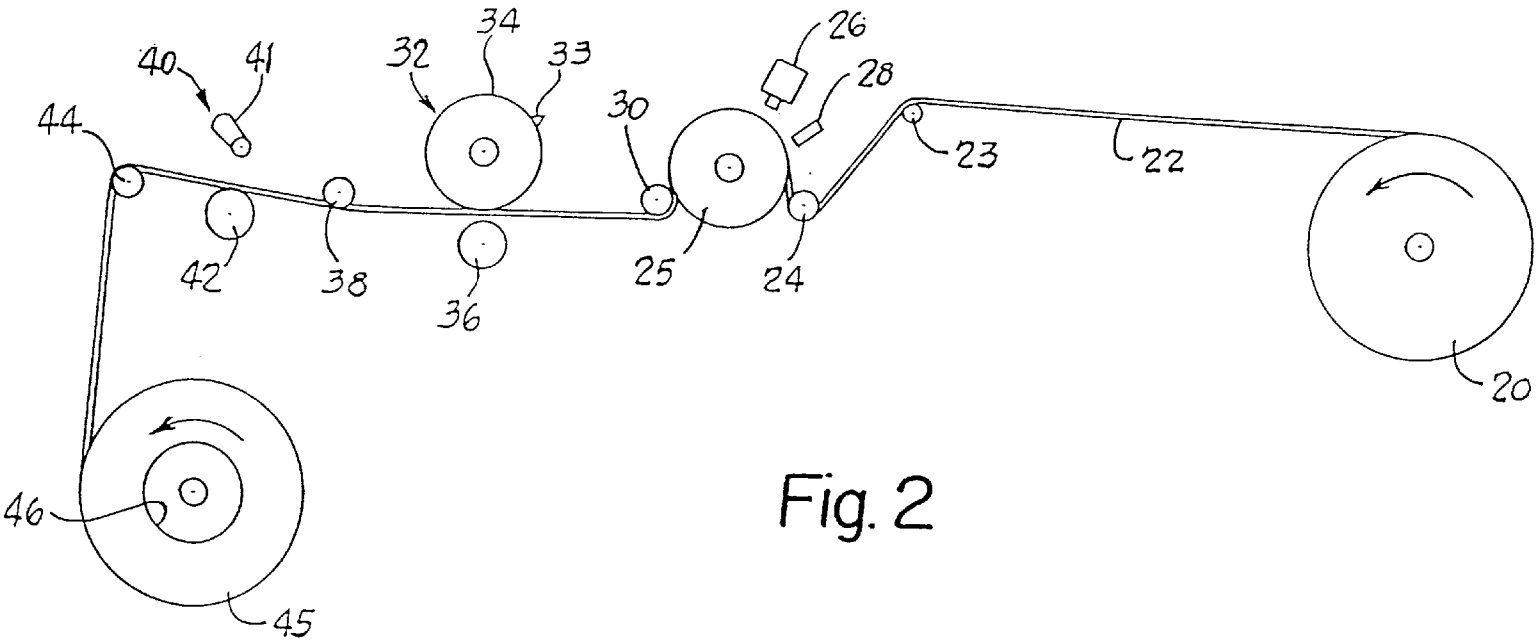
FIG. 2 is a schematic illustration of the manufacture of the bags of FIG. 1 and formation of the novel and improved.coil of this invention.

FIG. 2 is a schematic representation of a method and apparatus for manufacturing the novel coils of this invention. A supply coil of plastic tubing is shown at 20. For illustrative purposes the coil 20 in the schematic showing of FIG. 2 is shown as a web 22 in the form of a flattened tube, it being recognized that in commercial manufacture other procedures are often used especially where a higher volume is involved and two or more webs of bags may be concurrently formed.

The tubular web 22 is fed from the coil 20 over an idler roll 23 and then under a second idler roll 24. The web 22 then passes over a sealer roll 25. A shuttle sealer is shown schematically at 26. The shuttle sealer oscillates in an arcuate path moving into and out of sealing engagement with the web to form the spaced seals 19. In order to form seals at the appropriate longitudinally selected spacing the shuttle sealer 26 is under the control of a detector 28 which senses suitable indicia on the web.

After the web 22 passes from the sealer roll 25 it passes under another idler roll 30 and thence to a perforating station indicated at 32. At the perforating station tube piercers 33 on a perforating roll 34 pierce the web against a backup roll 36 to effect the formation of the lines of weakness which delineate the ends of adjacent bags.

After the web leaves the perforation station it passes under another idler roll 38 and thence to a bag opening station 40. A counterclockwise rotating eccentric 41 is provided at the opening station. The eccentric acts against the web and a backup roll 42 to separate the perforation of the upper ply and form the bag openings 17.

After the bags have been opened, the web passes over an idler 44 and then is tightly wound into a coil 45. The coil 45 has a central aperture 46 of a diameter at least as great as the width of the web 22 to provide a major feature of this invention. Another feature of this invention is that the web is tightly wound to form coil 45. The tight winding of the coil prevents the coil from collapsing and thus, maintains the central aperture 46 which is important for proper withdrawal of the web from the center. The coil should be wound so that the central aperture does not collapse or telescope, otherwise the coil will flatten during shipment and customers will not be able to mount or properly feed the roll. The appropriate tension can be determined by one of ordinary skill in the art depending on varying bag material, size and similar parameters. Preferably, the tension is 2 ounces per linear inch of width per millimeter of thickness.

The Bagging Machine

Figure 3:
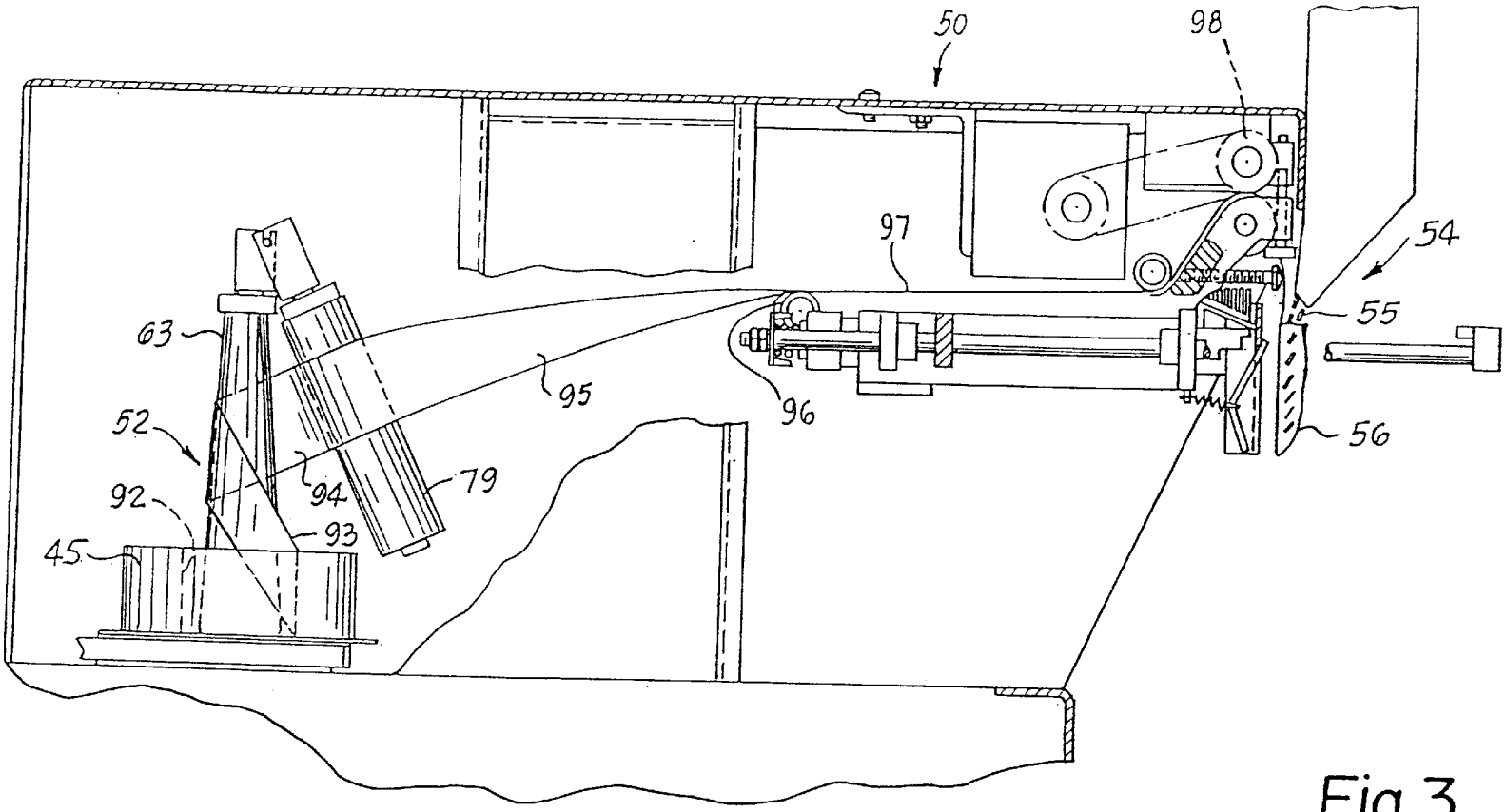
FIG. 3 is a fragmentary sectional view of a bag dispensing loading and sealing mechanism of the type disclosed in the H-100 Patents but modified to include the novel and improved bag dispenser of this invention which is shown in side elevational view.

Referring now to FIG. 3, a bagging machine is shown generally at 50. The bagging machine includes a dispensing mechanism shown generally at 52 which is at a dispensing location. The bagging machine 50, apart from the dispensing mechanism 52 is the same as the machines described in the H-100 Patents where a detailed description is provided.

The machine 50 includes a loading station shown generally at 54. The coil 45 is mounted on the dispensing mechanism 52. The web is fed with the bags moving closed end first from the coil and along a path of travel to the loading station 54.

The bags are sequentially and one at a time delivered the loading station 54. At the load station an end one 56 of the bags is opened by a flow of air, products indicated at 55 are fed into the opened bag and thereafter the machine closes and seals the bag. With the machine of the H-100 Patents the bag is separated from the web concurrently with the sealing operation and dropped onto a conveyor or into a receptacle. The web is then advanced to bring the next and now end one of the bags of the web into the loading station where it is inflated and so the process repeats.

The Dispensing Mechanism

Figure 4:
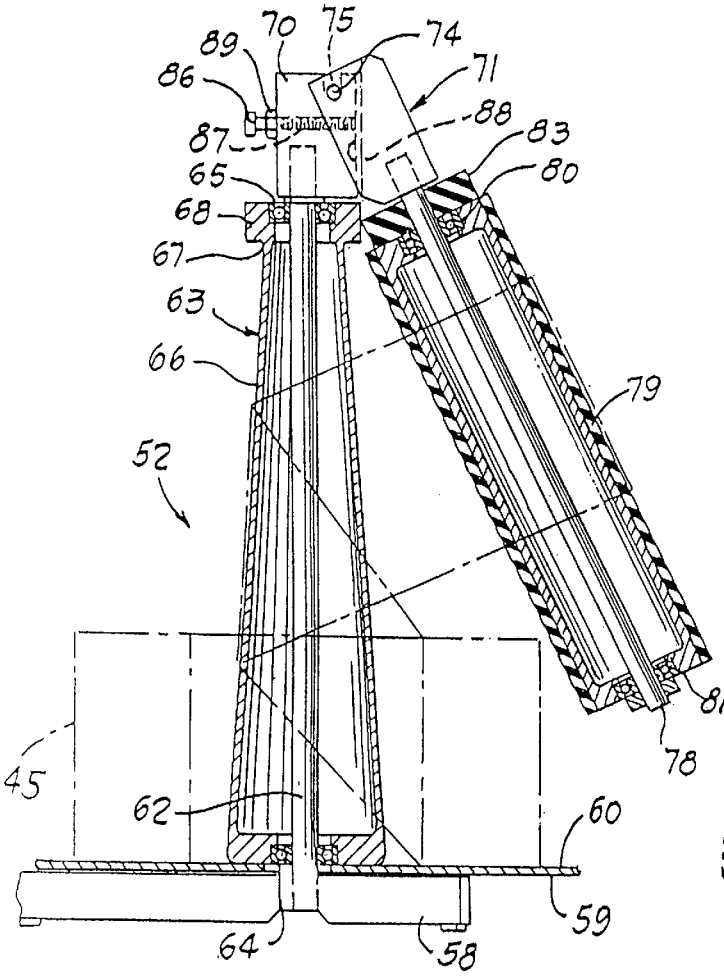
FIG. 4 is a sectional view of the dispenser on an enlarged scale with respect to FIG. 3.
Figure 5:
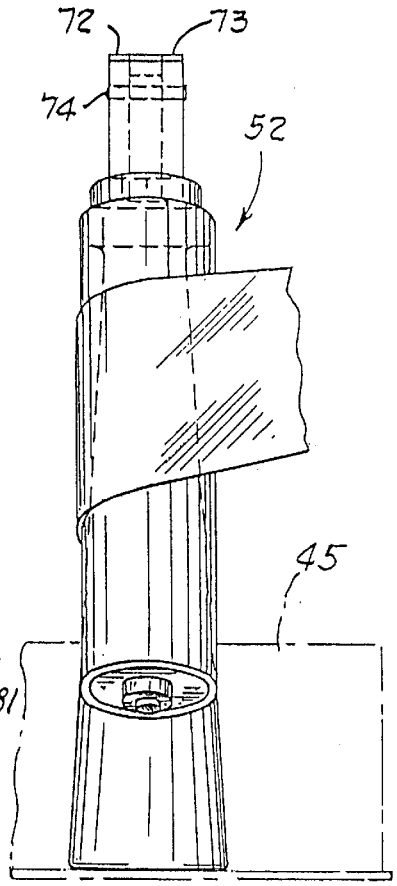
FIG. 5 is an elevational view of the dispenser as seen from a plane perpendicular to the plane of cross section of FIG. 4; and, FIG. 6 is an exploded schematic view of a stack of coils of bags coiled in accordance with this invention and interconnected together so bags are fed sequentially from the top coil to the bottom.
Figure 6:
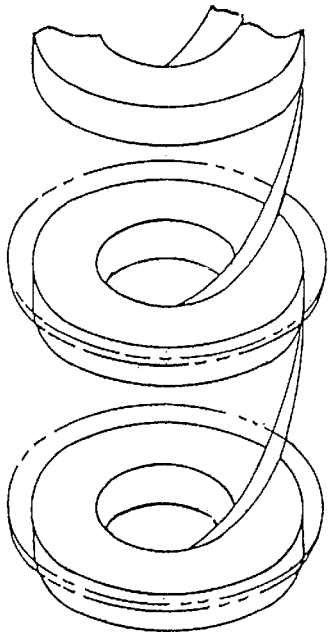

The dispensing mechanism 52 is best seen in FIGS. 4 and 5. The dispensing mechanism includes a base 58. A bag supporting table 59 is mounted on the base 58. The bag supporting table 59 includes a bag supporting surface 60 which is horizontal when the device is in use. A guide mandrel support shaft 62 is provided. The guide mandrel support shaft is fixed to the base 58 with an axis which is normal to the plane of the bag supporting surface 60. When the bag supporting surface is horizontal the guide mandrel support shaft projects vertically upwardly of the table 59.

A tapered control or guide mandrel 63 is provided. The guide mandrel is connected to the table 59. The table and tapered mandrel are journaled on the guide mandrel shaft by spaced bearings 64, 65. The guide mandrel 63 includes an upwardly tapering frusto conical shaped web guiding surface 66 which terminates at an upper smaller end 67. A cylindrically contoured driven section 68 is provided immediately above the smaller end 67.

A feed control mandrel support bracket 70 is mounted on the upper end of the guide mandrel support shaft 62. A feed control mandrel hanging bracket 71 is provided which is comprised of a pair of spaced bracket plates 72, 73, FIG. 5. The plates 72, 73 are bridged by a connecting pin 74.

The mandrel support bracket 70 includes an upwardly directed slot 75, FIG. 4. The slot 75 is laterally offset from an extension of the guide shaft axis and it is above the guide shaft. When the hanging bracket is mounted on the support bracket the pin 74 resides in the base of the slot 75 to provide a removable pivotal support for the hanging bracket 71.

A feed control mandrel shaft 78 is secured to the hanging bracket 71. When the hanging bracket is suspended from the support bracket in pivotal relationship the feed control mandrel shaft depends downwardly with its axis at an acute angle with the axis of the guide mandrel shaft 62. Extensions of the two shaft axes will intersect above the support bracket at, when the device is in use, a downwardly directed acute angle.

A cylindrical web feed control mandrel 79 is provided. The feed control mandrel 79 is journaled on the feed control mandrel shaft 78 by spaced bearings 80, 81. The feed control mandrel includes an elastomeric drive section 83 which is somewhat enlarged and of cylindrical configuration. When the dispenser is in use the drive section 83 is in driving engagement with the driven section 68.

In order to properly control the feed of the web from the coil 42, it is desirable to adjust the angular attitude of the feed control mandrel. Expressed another way it is desirable, in the preferred and disclosed embodiment, to adjust the size of the acute angle at which the axes of the two mandrel shafts intersect and the engagement of the drive and driven sections 83, 68. Accordingly, an adjustment screw 86 is provided. The adjustment screw 86 is threaded into and through a threaded bore 87 in the mandrel support bracket 86. An inner end of the adjustment screw 86 acts against a flat adjustment surface 88 on the base of hanging bracket. A lock nut 89 is provided to fix the adjustment screw in an adjusted position.

Operation

When the bagging machine 50 is put to use, the feed control mandrel 79 is removed. A coil of bags 42 is dropped over the tapered mandrel 63 and placed on the bag supporting surface 60. The coil of bags 42 is positioned in coaxial relationship with the tapered mandrel 63 and its shaft 62. Next the feed control mandrel is mounted in its depending relationship by placing the support pin 74 in the slot 75 of the support bracket 70. The angular relationship is, if required, adjusted by rotating the adjustment screw 86.

Once the coil 42 has been positioned on the table and the feed control mandrel positioned in its depending relationship, the time has come for the operator to feed the end bag 56 along the path of travel to the loading station 54. To this end the end bag is pulled from a central aperture 92 of the coil 42 and fed upwardly along a first span 93, FIG. 3, to engage the front of the feed control mandrel 63 as viewed in FIG. 3. The web is reeved around a portion of the tapered mandrel 63 and a second span 94 is fed upwardly and forwardly as viewed in FIG. 3 from the tapered mandrel at an upward angle which is reduced with respect to the span 93. The web is reeved around a section of the cylindrical surface of the feed control mandrel 79, thence along a twisting span 95, over a horizontally journaled idler roll 96 and thence along a feed span 97 through the machine in a manner described in greater detail in the H-100 Patents. The transverse dimension of the web along the feed span 97 is parallel to the transverse dimension of a bag positioned at the load station 54 as is the axis of the idler roll 96.

As the machine is cycled, the feed of the web is occasioned by a driven feed roll 98 of the bagging machine 50. Friction of the web with the tapered mandrel 63 and the inertia of the table 59 and tapered mandrel limit dispensing from the coil until the web firmly engages the feed control mandrel 69. Once the web engages the feed control mandrel, pulling of the web by the feed roll 98 will cause the feed control mandrel 69 to drive the tapered or guide mandrel causing it and the connected table 59 to rotate so that the span 93 maintains a substantially constant relationship with the guide mandrel. Thus, as the web is pulled by the driven feed roll 98 the tapered and cylindrical mandrels 63, 69 will rotate about their own axes so that there is no sliding of the web over the surfaces of the two mandrels.

It has been found that smooth and consistent feeding of the web from its coil 42 to the horizontal idler roll 96 is accomplished and that an equilibrium is reached when a constant angular relationship of the feed control mandrel to the first span 93 is maintained. More specifically, an imaginary vertical plane located by the axes of the tapered and feed control mandrels 63, 69 is at an angle of about 60 to 85 degrees with a second imaginary plane located by the axis of the tapered mandrel and the base of the first span 93 (that is an upstanding locus at which the web is departing from the coil).

Although several embodiments of the present invention have been illustrated and described herein in considerable detail, the present invention is not to be considered limited to the precise constructions disclosed. Various adaptations, modifications and uses of the invention may occur to those skilled in the art to which the invention relates and the intention is to cover all such adaptations, modifications and uses which fall within the spirit or scope of the appended claims.

I claim:

1. For use in packaging in which products are placed in bags an improved packaging material comprising:

a. an elongated plastic web of preopened bags in interconnected end-to-end relationship;

b. the web including a plurality of lines of weakness each extending transversely of the web, at least one such line of weakness being located between each contiguous pair of bags to delineate the ends of the contiguous bags and a parting line for facile separation of an adjacent bag from the web;

c. a plurality of transversely extending bag ply interconnections, at least certain of said interconnections each delineating the bottom of a space in a different one of the bags, the spaces being for receiving products during packaging operations;

d. each bag having an opening near a top end of the bag;

e. the web being flattened and wound in a coil having, prior to dispensing, a center opening of a diameter at least as great as the width of the web; and f. the coiled web being oriented such that as the web is fed along a path of travel from the center opening bags of the web are fed along such path closed end first.

2. The packaging material of claim 1 wherein each of the lines of weakness is a line of perforations.

3. The packaging material of claim 1 wherein each bag opening and the line of weakness delineating the top of the bag are longitudinally aligned.

4. The packaging material of claim 1 wherein the bag interconnections are heat seals.

5. For use in packaging in which products are placed in bags, an improved packaging material comprising:

a. an elongated plastic web of preopened bags in interconnected end-to-end relationship;

b. the web including a plurality of lines of weakness each extending transversely of the web, at least one such line of weakness being located between each contiguous pair of bags to delineate the ends of the contiguous bags and a parting line for facile separation of an adjacent bag from the web;

c. a plurality of transversely extending bag ply interconnections, at least certain of said interconnections each delineating the bottom of a space in a different one of the bags, the spaces being for receiving products during packaging operations;

d. each bag having an opening near a top end of the bag;

e. the web being flattened and wound in an annular coil having, prior to dispensing, a center opening from which the web is free to be fed for packaging operations, the opening being sized such that a web comprised of a series of such bags may be fed from the coil center opening to a packaging station without causing premature separation along one or more of such lines of weakness; and f. the coiled web being oriented such that as the web is fed from the center opening it will be fed along a path of travel with bags of the web being fed closed end first.

6. The packaging material of claim 5 wherein each of the lines of weakness is a line of perforations.

7. The packaging material of claim 5 wherein each bag opening and the line of weakness delineating the top of the bag are longitudinally aligned.

8. The packaging material of claim 5 wherein the bag interconnections are heat seals.

* * * * *